US008387622B1

(12) United States Patent
Moscovitch

(10) Patent No.: US 8,387,622 B1
(45) Date of Patent: Mar. 5, 2013

(54) CIGARETTE MAKING MACHINE

(75) Inventor: Ronald Moscovitch, Boca Raton, FL (US)

(73) Assignee: Simron International, Inc.

( * ) Notice: Subject to any disclaimer, the term of this patent is extended or adjusted under 35 U.S.C. 154(b) by 1022 days.

(21) Appl. No.: 12/277,923

(22) Filed: Nov. 25, 2008

(51) Int. Cl.
*A24C 5/00* (2006.01)

(52) U.S. Cl. ..... 131/70

(58) Field of Classification Search ..... 131/70–74
See application file for complete search history.

(56) References Cited

U.S. PATENT DOCUMENTS

| | | | |
|---|---|---|---|
| D250,965 | S | 1/1979 | Moscovitch |
| 4,167,948 | A | 9/1979 | Moscovitch |
| 4,770,191 | A | 9/1988 | Moscovitch |

*Primary Examiner* — Richard Crispino
*Assistant Examiner* — Dionne Walls Mayes
(74) *Attorney, Agent, or Firm* — Daniel S. Polley, P.A.

(57) ABSTRACT

A cigarette making machine is provided with an improved securement of the nozzle member to the casing of the machine. Another improvement is through the retraction of the internally disposed tobacco compactor which is slightly retracted in the final movement position of the operating handle so as to alleviate pressure or friction on the compacted tobacco by the compactor during movement of the compacted tobacco into the cigarette paper/sleeve disposed on the nozzle.

16 Claims, 10 Drawing Sheets

CIGARETTE MAKING MACHINE

FIELD OF THE INVENTION

The present invention relates to a machine for filling preformed paper cigarette tubes with tobacco and more particularly, relates to improvements therein.

BACKGROUND OF THE INVENTION

Cigarette-making machines which are adapted to take loose tobacco, compact the same, and inject the compacted tobacco in preformed paper cigarette tubes are well known. Examples of which include U.S. Pat. Nos. 4,770,191 and 4,167,948 issued Sep. 13, 1998 and Sep. 18, 1979, respectively to Moscovitch. One may also refer to U.S. Pat. Nos. 3,741,200; 3,127,900; and 3,886,952, all of which illustrate machines for filling the preformed paper cigarette tubes. The present invention machine is an improvement to the machine shown in U.S. Pat. No. 4,770,191 ("the 191 patent"). The '191 patent is incorporated by reference in its entirety.

SUMMARY OF THE INVENTION

The present invention generally provides an improved machine or apparatus for filling prefabricated hollow paper cigarette tubes in which the machine has means for effectively cutting any tobacco which may protrude from the tobacco-receiving chamber during the compaction of the tobacco. The machine of the present invention is improved from the one shown in the '191 patent through the slight retraction backwards by the compacting element at the end of the compacting step of the tobacco, which permits easier removal of the compacted tobacco residing in the chamber into the cigarette tube through the operation of the spoon/handle member of the machine.

The '191 patent is also improved through modifications made to the nozzle for which the cigarette tube is disposed on for receiving the compacted tobacco. The modifications help maintain the securement of the nozzle to the main casing or body housing for the machine, and help to prevent the nozzle from being pulled out of its secured relationship with the machine casing.

All other structural parts and their constructions, as well as their operation, in connection with making a cigarette are highly similar, and preferably the same, as such parts are described and illustrated in the above noted '191 patent, which has been incorporated by reference. For a better and complete understanding of the operation of the improved machine of the present invention, certain discussion of the structural parts and their operation will also be provided herein, even where such part has not been modified from the same part discussed and illustrated in the '191 patent.

The present invention cigarette machine is preferably for use with loose tobacco and preformed hollow cigarette paper tubes and preferably is provided with a means to maintain pressure on the cutting edges for cutting protruding tobacco despite normal manufacturing tolerances during the manufacturing process.

In operation, the machine has a cavity or a chamber formed in its body portion with a compacting member mounted for sliding movement within the body such that it will compact the tobacco which is placed in the chamber into an elongated cylindrical form. With the machine of the '191 patent, during the compaction movement, the compacting member moves from a first open position to a second closed position, closing off the opening into which the loose tobacco is placed. During this sliding movement, one edge of the tobacco compacting member is designed to shear any tobacco protruding from the chamber, the compacting member edge acting in conjunction with an edge defining the cavity or chamber. In a preferred embodiment of the present invention, the edge defining the chamber of cavity has a slight V-shaped configuration such that a double-scissor action is obtained between the two cutting or shearing edges.

The present invention improves on this design and recognizes the disadvantage of having the compacting member fully abutting up against the compacted tobacco when delivering the compacted tobacco to the paper tube. Thus, moving the level controlling the compacting member completely to its end position causes the compacting member (through a pivoting action) to slightly retract backwards away from the compacted tobacco so as not to interfere with the tobacco during its delivery to the cigarette tube.

The compacting member can be beveled slightly upwardly from its sides towards the center at least along the shearing edge. This beveled configuration, in conjunction with the design of the body portion, is adapted to ensure that good contact is made between the two shearing edges to effectively cut any excess tobacco protruding from the chamber. The compacting member can be designed to always maintain a pressure at the two cutting or shearing edges despite normal manufacturing tolerances. Thus, in one embodiment the compacting member can be provided with a lower leading edge that is somewhat flexible and is manufactured to be slightly larger than the cavity into which it is designed to fit such that a desired pressure is maintained, until the compact member is slightly retracted as described above before delivery of the compacted tobacco to the cigarette tube.

The present invention further provides an improved nozzle member which is secured to the machine housing (casing) in a way that its inadvertent removal during operation is greatly reduced, if not eliminated. The nozzle is also secure to reduce, if not eliminate, jamming of the tobacco which could occur during insertion of the compacted tobacco into the tube.

BRIEF DESCRIPTION OF THE DRAWINGS

Having thus generally described the invention, reference will be made to the accompanying drawings illustrating an embodiment thereof, in which.

DETAILED DESCRIPTION OF THE PREFERRED EMBODIMENT

Figure 1:
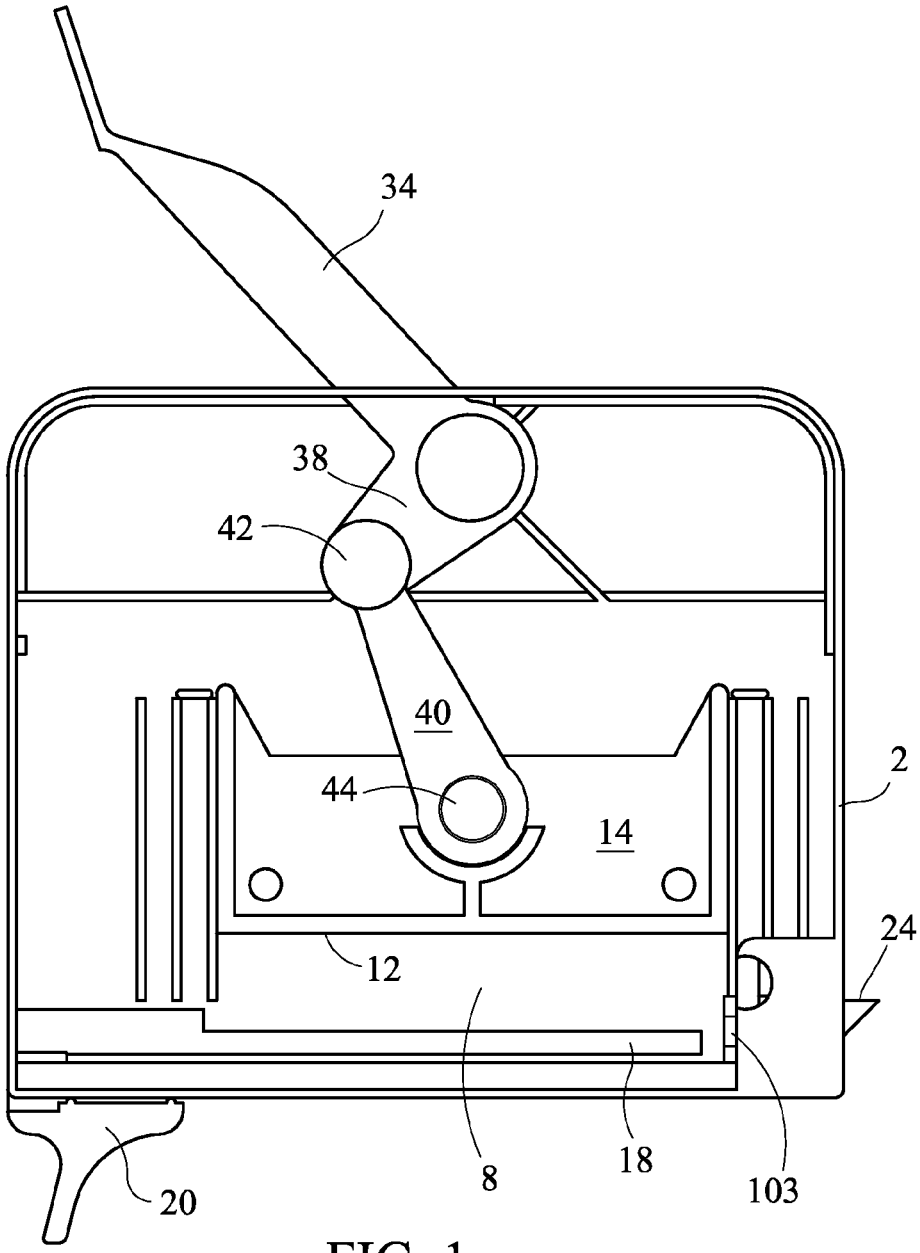
FIG. 1 is a sectional view of a cigarette making machine in accordance with the present invention illustrating the improved controller for the compacting member and the compacting member in a fully opened (starting) position.
Figure 2:
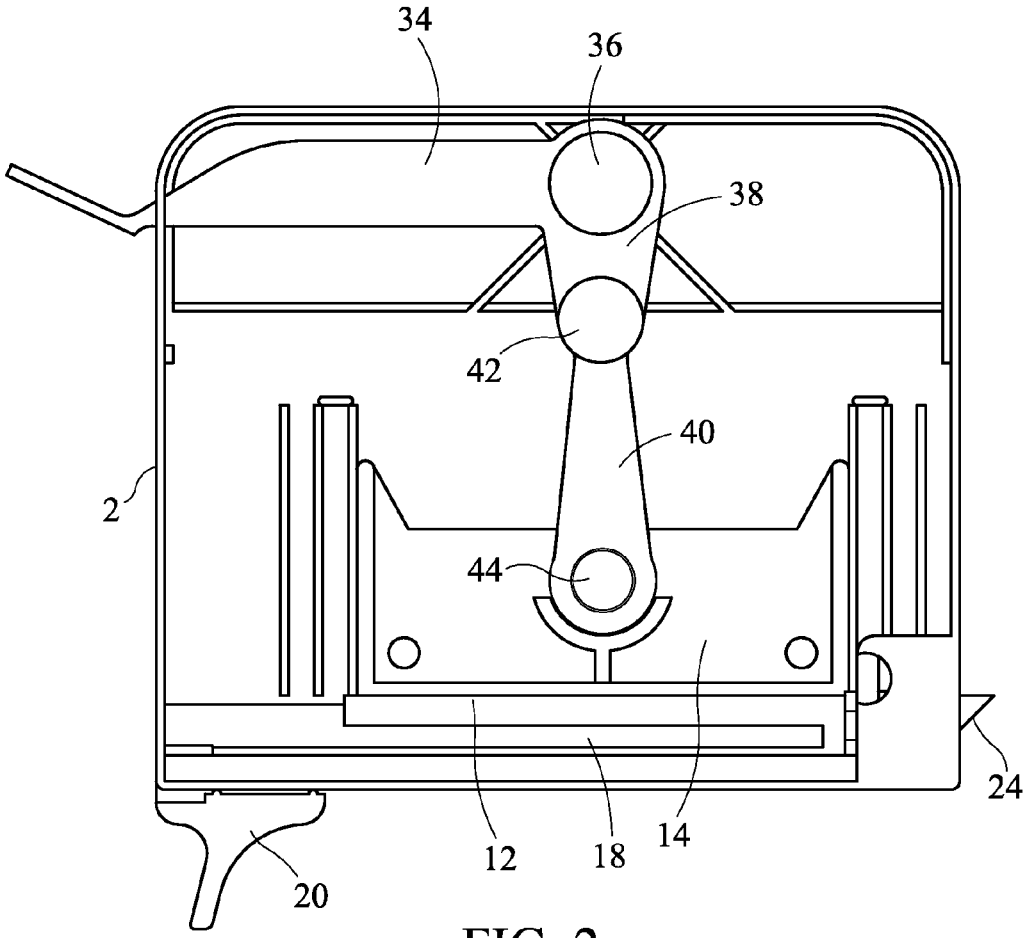
FIG. 2 is a sectional view of the cigarette making machine of FIG. 1 illustrating the improved controller and the compacting member in a fully closed compacting position.
Figure 3:
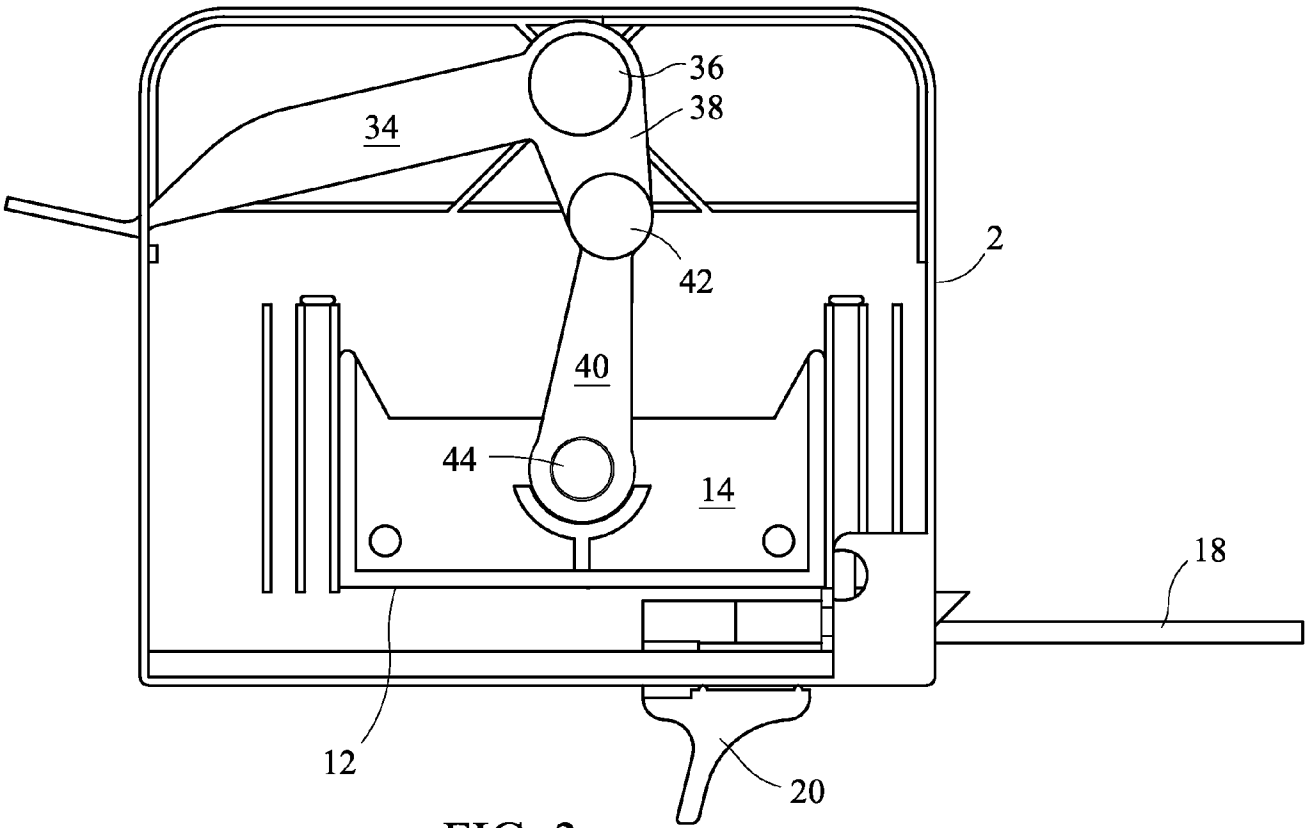
FIG. 3 is a sectional view of the cigarette making machine of FIG. 1 illustrating the improved controller in the ending position and the compacting member in its retracted position after the compacted member has compacting the inserted loose tobacco as shown in FIG. 2.
Figure 4:
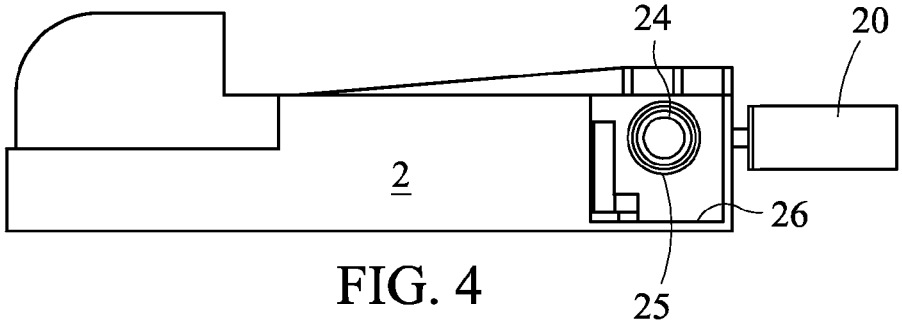
FIG. 4 is a side partial cutaway view illustrating the design of the nozzle aperture in the casing having aligned grooves which mate with the side protrusions along the body of the nozzle for securely retaining the nozzle to the casing.

The particular cigarette making machine shown in the drawings has a body or casing unit or housing 2 having on its upper surface adjacent a front edge of the machine an elongated aperture 6 for receiving a supply of tobacco as will be described in greater detail hereinbelow. Opening 6 opens into a chamber 8 defined by a bottom member 10 and a leading upper concave surface portion of a spoon member 18. Spoon member 18 is secured to a spoon handle 20 and the spoon handle 20 and spoon member 18 are movable from their initial tobacco loading position as seen in FIGS. 1 and 2, to a tobacco injecting position as shown in FIG. 3 to inject a wad of tobacco into a cigarette tube (not shown) which is positioned on a nozzle 24 which is rigidly secured to the casing 2 and described in more detail below. The nozzle 24 may be positioned within a corner cutout portion 26 of casing 2.

Bottom 10 defining chamber 8 is secured to the casing 2. A tobacco compacting member 14 having a concave leading edge 12 is positioned for reciprocal movement within casing 2, with this reciprocal movement being dependent upon the actual positioning and movement of a main operating lever 34. Operating lever 34 is pivotally carried by the casing 2 by means of screw or stud 36. Lever 34 is of bell-crank lever configuration and an inner angled arm 38 of lever 34 is pivotally secured to a link member 40 by means of a pivot 42. The other end of link member 40 is pivotally secured to tobacco compacting member 14 by means of a pivot 44, and it will be appreciated that movement of lever 34 from the position shown in FIG. 1 to the position shown in FIG. 3, and the in-between position of FIG. 2 will cause movement of tobacco compacting member 14 from the "open" position shown in FIG. 1 to the "closed" position shown in FIG. 2 and ending in the slightly retracted position of FIG. 3, whereby tobacco positioned in chamber 8 through opening 6 will be compacted against the concave spoon 18 to form a cylindrical rod of tobacco (not shown) ready for injection into a tube (not shown) positioned on nozzle 24, without any frictional interference from compacting member 14 as it has been slightly retracted out of the way (See FIG. 3).

As described and shown in the '191 patent, incorporated by reference in its entirety herein, parallel slots may be provided in compacting member 14 and by providing guides in the form of downwardly projecting studs on the lower surface of the casing 2, it will be appreciated that the slots move along the guides during movement of lever 34 to maintain the tobacco compacting member 14 in precise alignment with the concave spoon member 18 and between which the wad of tobacco is compacted.

In operation the user pivots operating lever 34 to the position shown in FIG. 1 which withdraws the tobacco compacting member 14 to the "open" position shown in this view. The handle 20 and spoon 18 will also be moved to the position shown in FIG. 1 so that the chamber is ready for the reception of a supply of tobacco. After the tobacco is positioned in the chamber, lever 34 is then ultimately pivoted to the position shown in FIG. 3, wherein during its travel to the slightly retracted position of FIG. 3, compacter 14 had been in a fully compacted position (FIG. 2). During this operation, the tobacco (not shown) is compacted in cylindrical rod form between the concave leading edge 12 of the compacting member 14 and the concave spoon 18. With lever 34 in the position of FIG. 3, causing compacter 14 to be slightly retracted, handle 20 is then moved to the position shown in FIG. 3 whereby the compacted wad of tobacco is injected into a tube previously positioned on nozzle 24. By being slightly retracted, compacter does not interfere (such as by friction) with the movement of the compacted wad of tobacco into the positioned tube by spoon 18/handle 20. Permitting lever 34 to be moved to create the slight pivot or angular relationship between arm 38 with link 40 (see FIG. 3) is what causes compacting member 14 to be slightly retracted after it has first compacted the loose tobacco into the compacted wad.

To retain a tube on the nozzle during injection a tube retaining lever 52 can be provided. As shown and described in the '191 patent, tube retaining lever 52 can be of a bell-crank configuration and is secured for pivotal movement to the bottom surface of the bottom 10 by means of a pivot. A spring 56 extends between the side of the casing and lever 52 and the action of the spring is to normally hold a tip on the outermost end of lever 52 against nozzle 24. The innermost end of lever 52 is provided with a stud which is positioned to be contacted by link 40. When handle 34 is in the position shown in FIG. 1, the stud is contacted by link 40 and lever 52 is pivoted against the action of spring 56 such that the lever tip is removed from nozzle 24. It is in this position that a tube will be positioned on nozzle 24. When handle 34 is moved to the slightly retracted compacter position as shown in FIG. 3, spring 56 moves lever 52 to its tube retaining position.

Similar to the operation shown and described in the '191 patent, during the movement of the tobacco compacting member from a open position to a closed position, a leading edge of concave surface 12 will contact edge 15 of body unit 2 to cut any protruding tobacco.

Figure 5:
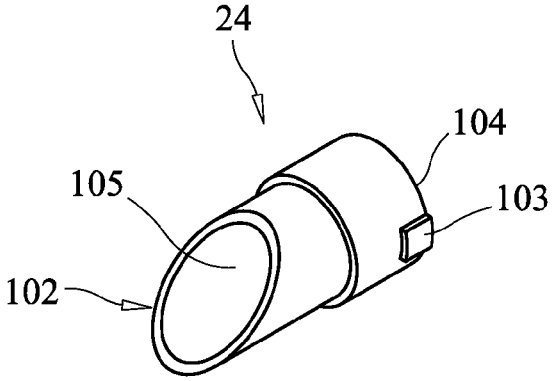
FIG. 5 is a perspective view of the improved nozzle in accordance with the present invention.
Figure 6:
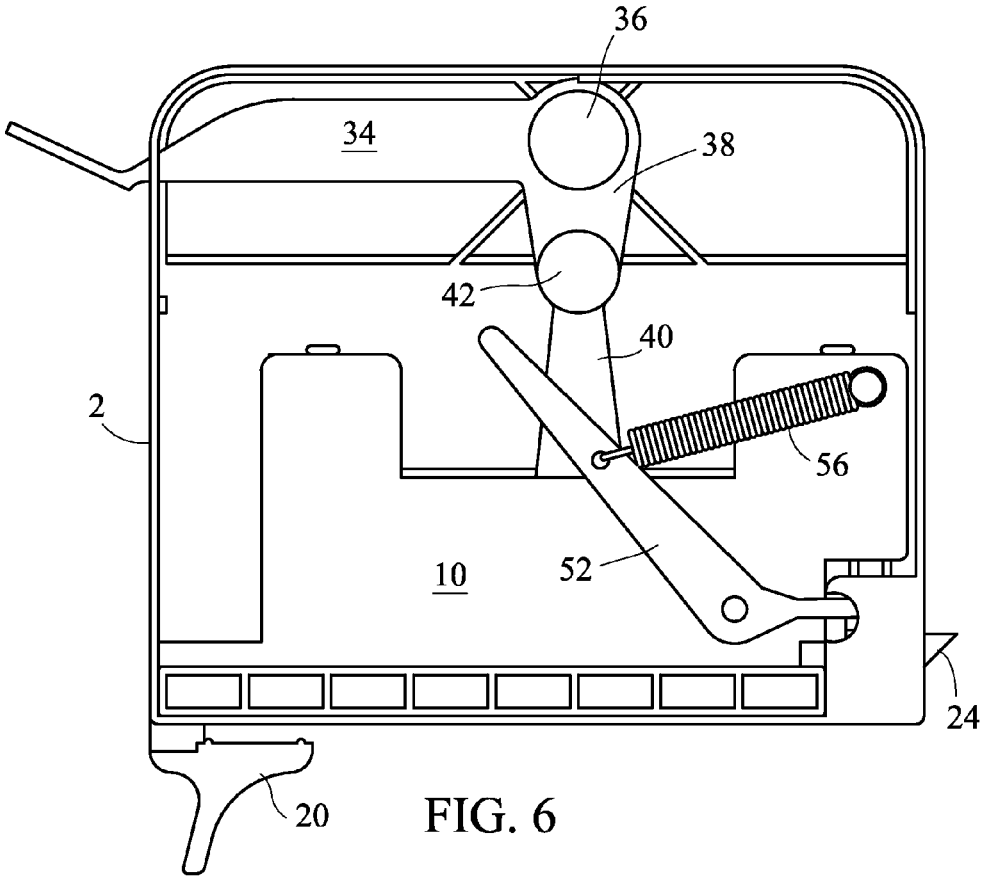
FIG. 6 is a bottom view of the cigarette making machine shown in the compacter position of FIG. 2 and showing the bottom member secured to the casing and with the bottom secured loose tobacco shavings/leaves catcher removed.
Figure 7:
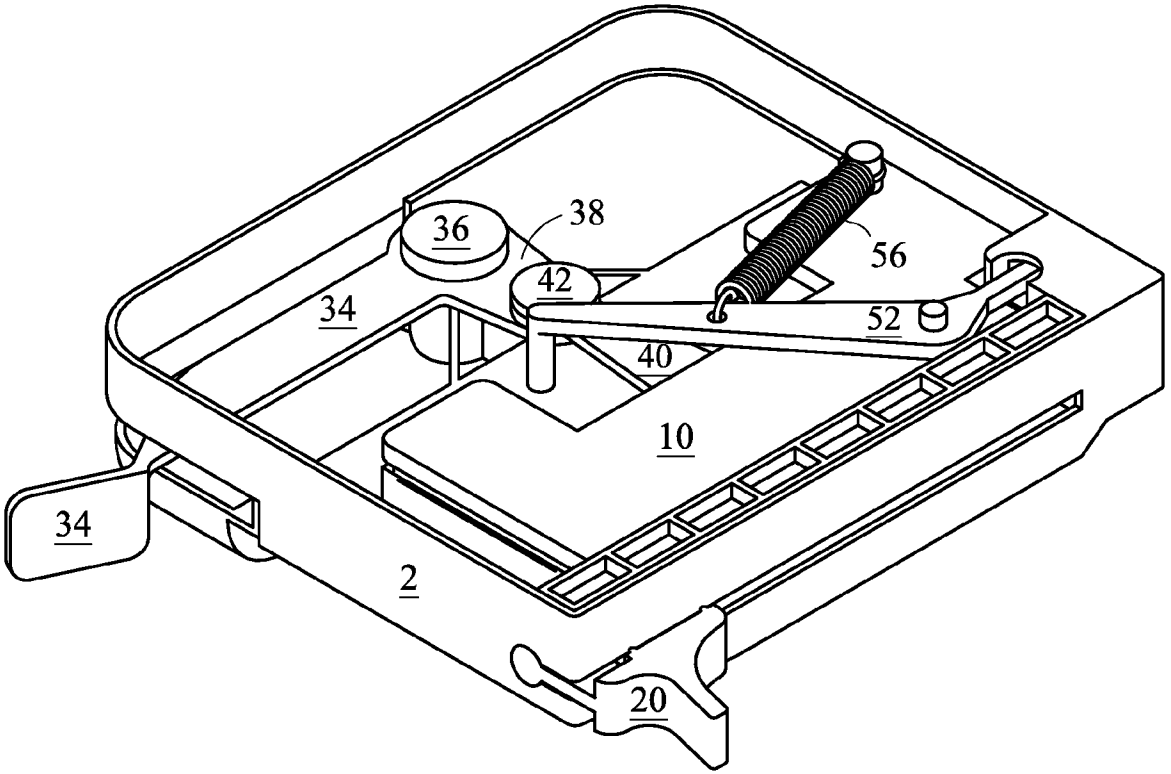
FIG. 7 is a perspective of the machine shown in FIG. 6.
Figure 8:
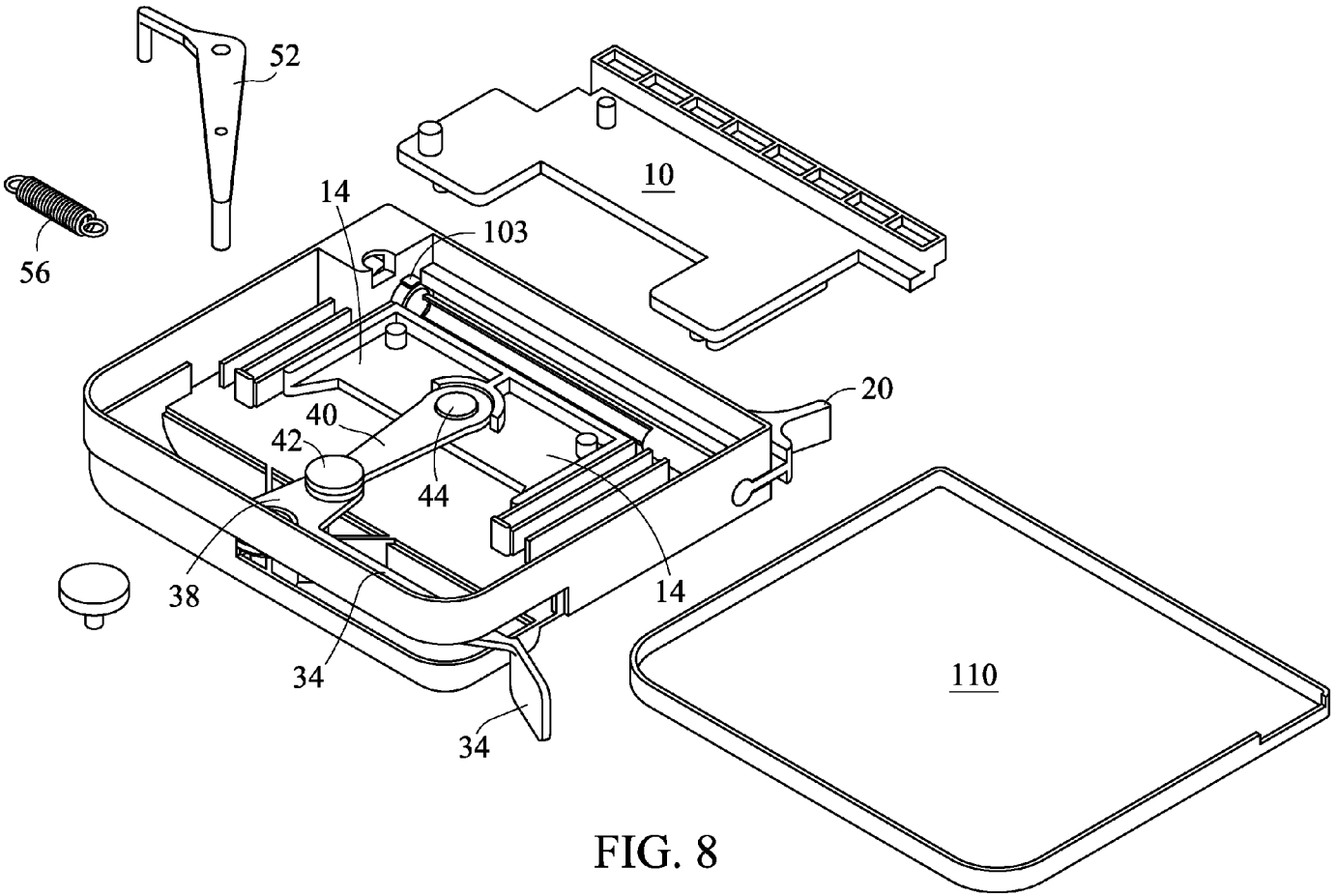
FIG. 8 is a partially exploded perspective view of the cigarette making machine in accordance with the present invention shown with the compacter in a fully compacted position of FIG. 2.

Nozzle 24, as shown in FIG. 5, has a discharge end generally indicated by reference numeral 102 and an inlet end indicated by reference numeral 104. As shown and described in the '191 patent, a portion of an internal wall 105 of nozzle 24 can be tapered such that when the tobacco is inserted in nozzle 24 at inlet end 104, no "snagging" can occur since the wall is preferably tapered inwardly to smoothly guide the tobacco.

Figure 11:
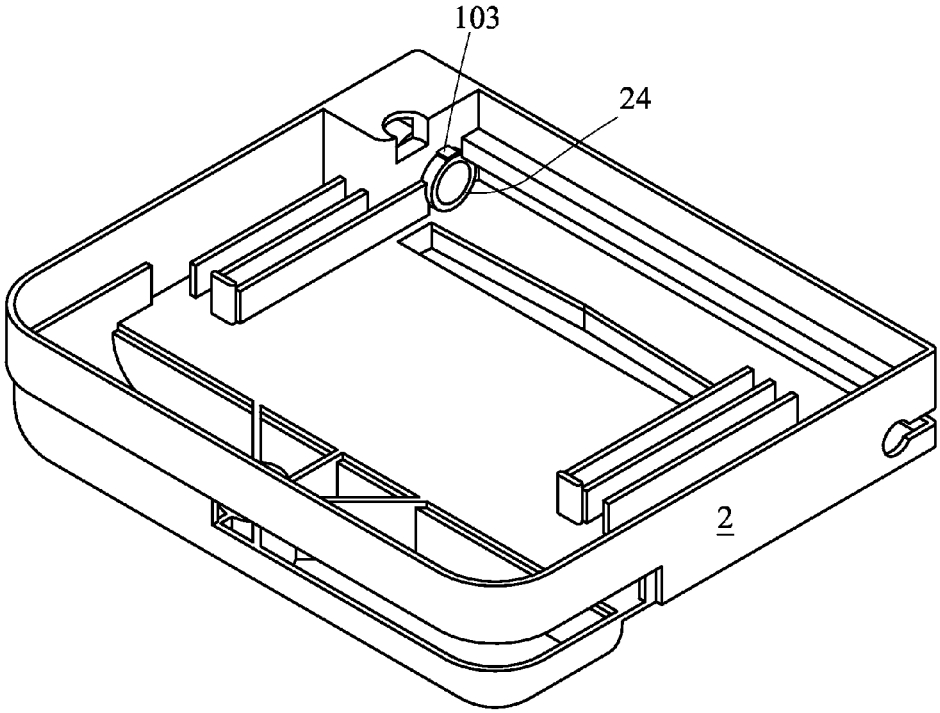
FIG. 11 illustrates a perspective view of the lower half of the casing unit showing the nozzle secured in accordance with the present invention.

As seen in FIG. 11, nozzle 24 can also be provided with one or external protrusions 103 which in one embodiment abuts up against an inner wall in casing 2 to prevent nozzle 24 from inadvertently being pulled through opening 25 in casing 2. Alternatively, grooves or slots can be provided in casing 2 when securing nozzle 24 to casing 2. This alignment of protrusion(s) 103 within the casing grooves helps to securely retain nozzle 24 to casing 2 and helps to reduce, if not prevent, nozzle 24 from being removed from its position when making a cigarette using the present invention machine. It should also be recognized that the diameter size of nozzle 24 is not limited to any particular size and all diameter sized for nozzle 24 can be used and are considered within the scope of the invention. Additionally, various sized diameter nozzle can be switched and interchanged and secured to casing 2, to create cigarettes of differing diameters using the same present invention machine.

Figure 9:
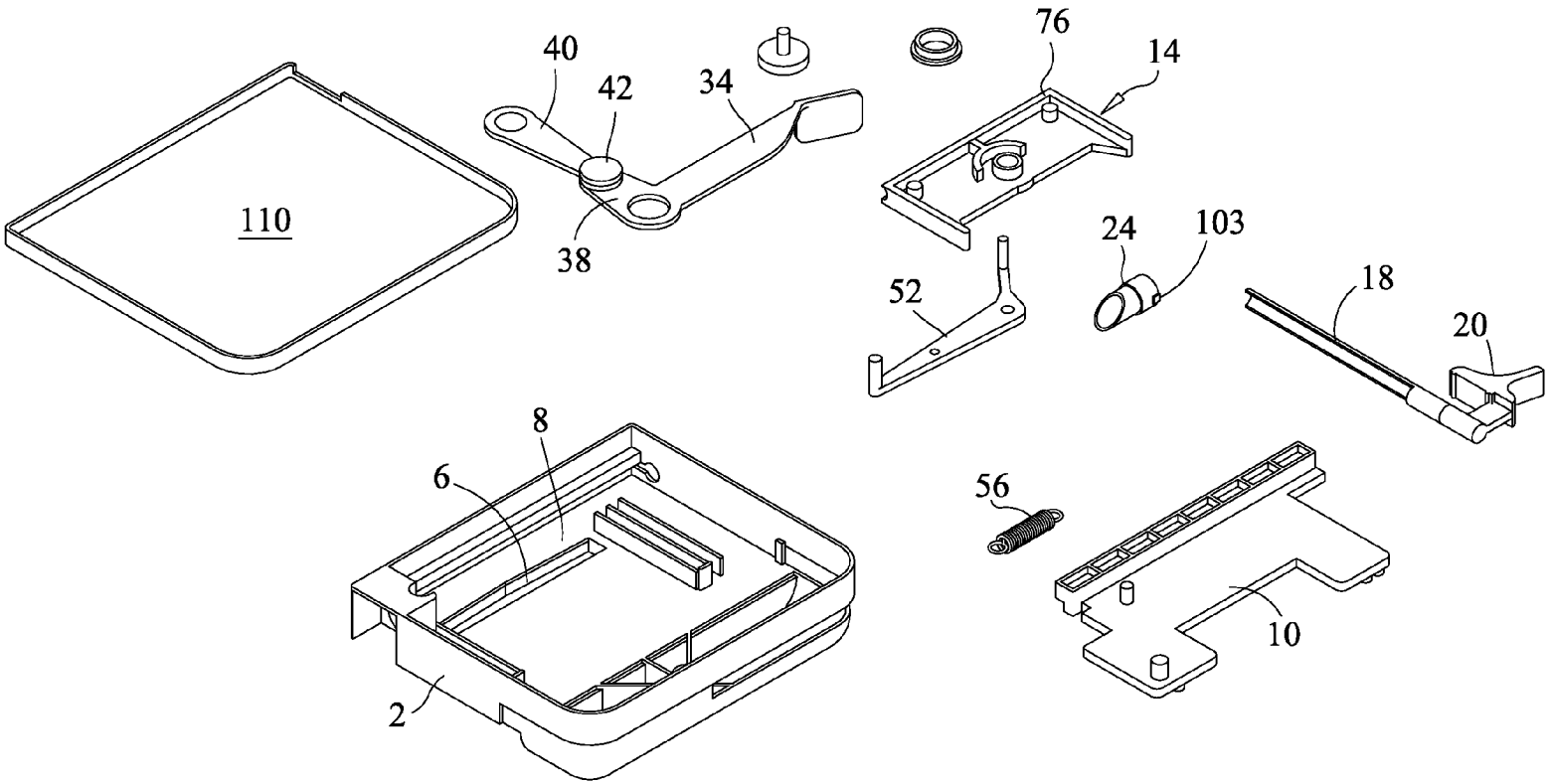
FIG. 9 is a fully exploded perspective view of the cigarette making machine in accordance with the present invention.
Figure 10A:
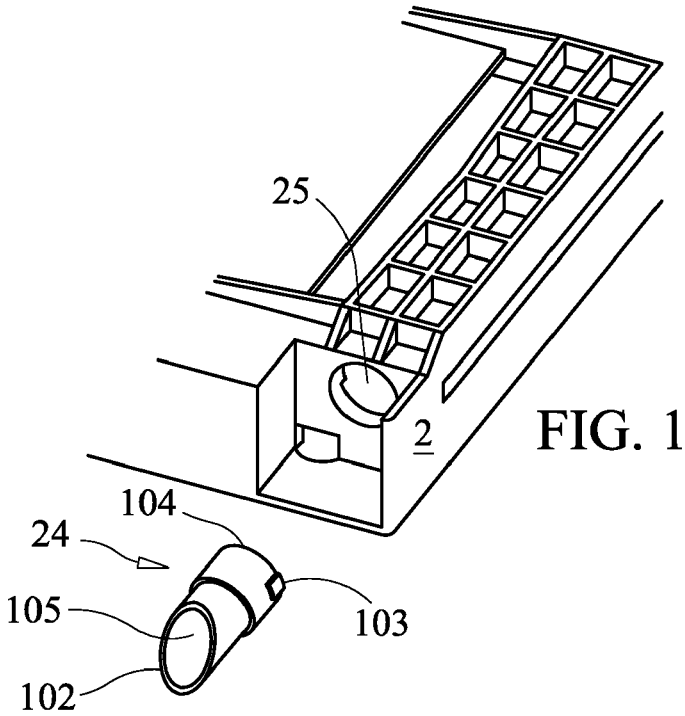
FIG. 10*a* illustrates the nozzle opening area of the casing unit for the cigarette making machine in accordance with the present invention.
Figure 10B:
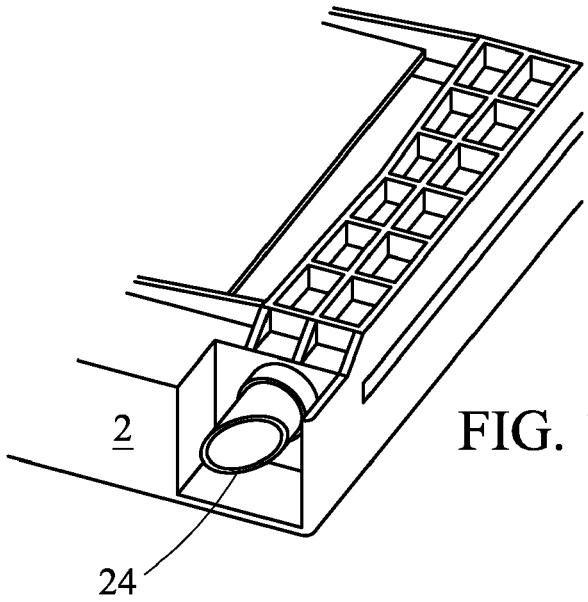
FIG. 10*b* illustrates the nozzle opening area of the casing unit of FIG. 10*a* with the nozzle secured therein.

Referring to FIG. 9, a preferred embodiment of compacting member 14 is shown. The '191 patent also illustrates and described a compacting member that can be used with the present invention. As seen in FIG. 9 herein, compacting member 14 has an upper surface 76 and a leading edge portion of concave surface 12 can meet upper surface 76 at an angle slightly less than 90 degree, wherein the leading edge portion can be angled inwardly to form an angle of less than 90 degrees with respect to upper surface 76. Compacting member 14 is preferably formed of a plastic material, though other materials can be selected and are considered within the scope of the invention, and due to its preferred thin nature of its leading lower edge it is flexible and will fit within the channel wherein compacting member 14 is placed. As will be appreciated, the manufacture of compacting member 14 and body unit 2 is subject to normal manufacturing tolerances. With the use of a flexible leading lower edge, a good contact between the leading upper edge and a cutting edge 15 is maintained.

Similar as shown and described in the '191 patent, body unit 2 can be reinforced about aperture 6. To this end, there is provided a pair of ribs extending about opposite sides of aperture 6 can be provided and a further pair of ribs and can extend between ribs 71 with rib 72 to define a wall adjacent aperture 6 and rib 73 being along the front edge of body unit 2. A plurality of further ribs can run between ribs 72 and 73. The use of all the above ribs gives reinforcement to the area between the front edge of body unit 2 and aperture 6.

As shown and described in the '191 patent, a cutting edge can be provided with a substantially V-shaped configuration such that the cutting edge on compacting member 14 will have an initial point of contact adjacent the sides and the contact will progress inwardly to the "point" of the V-configuration. In other words, a dual scissors-like action is utilized.

During the contact of the cutting edge of compacter/cutter 14 and the V-shaped cutting edge, essentially a point contact between cutting edges is maintained whereby loose protruding tobacco is sheared. Also, an upwardly beveled surface of compacting member 14 acts to maintain a slightly increasing upward pressure between the cutting edges. In this respect, a bevel in the order of approximately 0.0005 inch is normally sufficient although a lesser or a greater bevel may be utilized.

It will be appreciated that the above described embodiments are for purposes of illustration only and that changes and modifications may be made thereto without departing from the spirit and scope of the invention. Thus, while there has been described a compacting member which is both beveled and has a flexible lower leading edge, both of which are adapted to maintain effective contact between the cutting edges, a single one of these means may be effectively employed. Furthermore, although the modifications have been made to certain portions of the compacting member, equivalent changes to the body portion may equally well be employed.

Thus, as shown above, the improved cigarette making machine of the present invention provides for a more secure retainment of nozzle 24 to casing 2 and incorporates a retractable pivoting motion with the handle and link system to cause the slight retraction of cutter/compacter 14 at the end of the cutting operation, so as not to interfere or complicate the loading of the compacted wad of tobacco into the cigarette tube secured to nozzle 24.

Lastly, a plastic or other material bottom cover 110 can be secured underneath to casing 2 by any conventional means to catch any loose tobacco leaves or shavings that may escape during operation or loading of the present invention cigarette making machine.

Though preferably the retraction of compactor 14 is slight, the invention is not limited to any particular length of retraction and all retractions back from the compacting position are considered within the scope of the invention. Additionally, the invention is not limited to any particular angles between the inner angled arm and the link member for the open/starting position or for the final retracted position and any angles which will accomplish the goals of the invention can be selected and are considered within the scope of the invention.

While the invention has been described and disclosed in certain terms and has disclosed certain embodiments or modifications, person skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. In a cigarette-making machine having a body portion, a cavity adapted to receive loose tobacco and a compacting member movable in the body portion to compact loose tobacco placed in the cavity, and an operating lever to move said compacting member; the improvement comprising said compacting member being movable from a first open position to an intermediate compacting position and to a final retracted position through movement of said operating lever from a first starting position to second ending position, wherein in said final retracted position said compacting member is located closer to its location in the first open position as compared to where it is located during the intermediate compacting position.

2. The improvement of claim 1 wherein said means an operating lever has an elongated portion which includes a handle at an outer end and having an inner angled arm, said operating lever pivotally secured to said body portion;

wherein said improvement further comprises:

a link member pivotally secured to said inner angled arm and pivotally secured to said compacting member;

wherein a part of the elongated portion extends through a slot in said body portion such that the handle is disposed outside of the body portion and externally accessible to a user; said slot having a first end and a second end;

wherein said first end of said slot is associated with the first starting position for said handle and said second end of said slot is associated with the second ending position of said handle.

3. The improvement of claim 2 wherein in said first starting position said elongated portion is adjacent the first end of said slot and said inner angled arm and said link member are angled in a first direction causing said compacting member to be in the first open position.

4. The improvement of claim 3 wherein in said second ending position said elongated portion is adjacent said second end of said slot and said inner angled arm and said link member are angled in a second direction causing said compacting member to be in the final slightly retracted position, wherein said second direction is substantially opposite of said first direction.

5. The improvement of claim 2 wherein in said second ending position said elongated portion is adjacent said second end of said slot and said inner angled arm and said link member are angled in a direction causing said compacting member to be in the final slightly retracted position.

6. The improvement of claim 2 wherein in said compacting position said elongated portion is disposed intermediate between said first end and said second end of said slot and said link member and said inner angled arm are substantially parallel with each other causing said compacting member to be in the intermediate compacting position.

7. The improvement of claim 6 wherein when said handle is in said second ending position said compacting member is in said retracted position.

8. The improvement of claim 2 wherein prior to said compacting member reaching the intermediate compacting position a securement point of said link to said inner angled arm points toward a first end of the body member and when said compacted member reaches the final retracted position after reaching the intermediate compacting position the securement point points to a second end of the body member which is opposite to the first end of the body member.

9. The improvement of claim 1 wherein said operating lever has an elongated portion which includes a handle at an outer end and having an inner angled arm;

wherein said improvement further comprises:

a link member pivotally secured to said inner angled arm and pivotally secured to said compacting member.

10. The improvement of claim 9 wherein in said compacting position said elongated portion is disposed intermediate between said first end and said second end of said slot and said link member and said inner angled arm are substantially parallel with each other causing said compacting member to be in the intermediate compacting position.

11. The improvement of claim 9 wherein when said handle is in said second ending position said compacting member is in said retracted position.

12. The improvement of claim 9 wherein prior to said compacting member reaching the intermediate compacting position a securement point of said link to said inner angled arm points toward a first end of the body member and when said compacted member reaches the final retracted position after reaching the intermediate compacting position the securement point points to a second end of the body member which is opposite to the first end of the body member.

13. The improvement of claim 1 wherein when said operating lever is in said second ending position said compacting member is in said retracted position.

14. In a cigarette-making machine having a body portion, a cavity adapted to receive loose tobacco and a compacting member movable in the body portion to compact loose tobacco placed in the cavity, and means to cause movement of said compacting member; the improvement comprising said compacting member being movable from a first open position to an intermediate compacting position and to a final retracted position through movement of a handle of said means to cause movement from a first starting position to second ending position;

wherein said means to cause movement of said compacting member comprises:

an operating lever an elongated portion of which includes the handle at an outer end and has an inner angled arm, said operating lever pivotally secured to said body portion;

a link member pivotally secured to said inner angled arm and pivotally secured to said compacting member;

wherein a part of the elongated portion extends through a slot in said body portion such that the handle is disposed outside of the body portion and externally accessible to a user; said slot having a first end and a second end;

wherein said first end of said slot is associated with the first starting position for said handle and said second end of said slot is associated with the second ending position of said handle;

wherein in said compacting position said elongated portion is disposed intermediate between said first end and said second end of said slot and said link member and said inner angled arm are substantially parallel with each other causing said compacting member to be in the intermediate compacting position.

15. The improvement of claim 14 wherein in said compacting position said elongated portion is closed to said second end of said slot than said first end of said slot.

16. A method for compacting loose tobacco by a cigarette-making machine, the cigarette-making machine having a body portion, a cavity adapted to receive loose tobacco and a compacting member movable in the body portion to compact loose tobacco placed in the cavity, said method comprising the steps of:

(a) moving said compacting member within said body portion from a first open position to an intermediate compacting position where the compacting member contacts and compacts the loose tobacco; and (b) moving said compacting member within said body portion from the intermediate compacting position to a final retracted position;

wherein in the final retracted position said compacting member is located closer to its location in the first open position within said body portion as compared to where it is located during the intermediate compacting position.

* * * * *